United States Patent [19]

Huebsch et al.

[11] 4,191,248

[45] Mar. 4, 1980

[54] TANDEM SOLENOID-CONTROLLED SAFETY CUT-OFF VALVE FOR A FLUID WELL

[76] Inventors: Donald L. Huebsch, 3716 Prestwick Dr., Los Angeles, Calif. 90027; Louis B. Paulos, 9616 Yolanda Ave., Northridge, Calif. 91324

[21] Appl. No.: 866,335

[22] Filed: Jan. 3, 1978

[51] Int. Cl.[2] ..... E21B 43/12; F16K 31/08; H01F 7/16

[52] U.S. Cl. ..... 166/65 M; 166/332; 251/137; 335/267; 335/253

[58] Field of Search ..... 166/65 R, 65 M, 316, 166/332; 251/137, 139; 137/498, 521; 335/267, 266, 232, 229, 253

[56] References Cited

U.S. PATENT DOCUMENTS

| | | | |
|---|---|---|---|
| 2,901,210 | 8/1959 | Hebard | 335/267 X |
| 3,032,111 | 5/1962 | Corley, Jr. et al. | 166/65 R |
| 3,275,964 | 9/1966 | Kumm | 251/137 X |
| 3,389,355 | 6/1968 | Schroeder, Jr. | 251/137 X |
| 3,430,120 | 2/1969 | Kotaka et al. | 335/267 X |
| 3,447,776 | 6/1969 | Blumer | 251/137 X |
| 3,621,422 | 11/1971 | Macy | 335/267 X |
| 3,861,464 | 1/1975 | Boyadjieff et al. | 166/332 |
| 3,910,352 | 10/1975 | Mott | 166/321 X |

*Primary Examiner*—Stephen J. Novosad
*Attorney, Agent, or Firm*—Sellers and Brace

[57] ABSTRACT

A tandem solenoid fail-safe sub-surface safety cut-off valve for fluid wells controllable from the surface and suitable for installation at substantially greater depths than prior constructions. The valve assembly may be installable and retrievable either via wire line or tubing techniques and utilizes tandem electromagnetic means to operate either a flapper or a ball cut-off valve. The solenoid coils embrace a landing nipple portion of the tubing string or the tubing string itself and hold either type of cut-off valve open against spring pressure only so long as the coils are energized thereby providing surface control of the safety cut-off valve normally and assurance of closing of this valve by energy stored in spring means in the event of power failure through accident or some catastrophe as well as automatic closure if flow velocity increases beyond a predetermined safe value. The tandem solenoids provide abundant operating energy while utilizing a minimum of radial space between the casing and the tubing string.

63 Claims, 27 Drawing Figures

TANDEM SOLENOID-CONTROLLED SAFETY CUT-OFF VALVE FOR A FLUID WELL

This invention relates to a sub-surface safety cut-off valve, and more particularly to an improved fail-safe safety cut-off valve utilizing tandem electromagnetic actuating means controllable from the surface equally suitable for a wire line installation or tubing string retrievable mode.

BACKGROUND OF THE INVENTION

It is critically essential that petroleum wells have suitable provision for protecting the well against certain hazards commonly encountered in the operation of such wells. Abnormal conditions can be encountered suddenly and without advance notice. Thus there may be a sudden release of undergrounding pressure causing the well to go wild and out of control. Even under normal operating conditions it is often desirable to interrupt flow at sub-surface depths.

To meet the foregoing and the like contingencies numerous cut-off valve constructions have been proposed heretofore incorporating the capability of responding to emergency conditions to interrupt flow. Although these various types are in widespread daily use, they are subject to certain disadvantages and shortcomings avoided by this invention. One common type employs a flapper valve pivotally supported along the interior sidewall of the flow passage and held open by a protector tube so long as normal operating conditions prevail. Some safety valves of this type respond to an abnormal increase in the flow velocity to close automatically whereas others are held in open position hydraulically by static pressure means controlled from the ground surface. Another type of safety cut-off valve in use employs a rotary ball valve held in open position by hydraulic pressure controlled at the well head. Among the serious shortcomings of certain of these valves is the fact that one or more springs is relied upon to close the valve operating mechanism and these springs are required to operate in opposition to the static hydraulic head in the line employed to open the valve. For this reason, it has been found impractical to utilize such valves at a depth in excess of about 500 feet. This is a highly objectionable and serious limitation on land based wells, and particularly as respects wells beneath the sea bed. Moreover, prior safety cutoff valves lack the capability of control at will from ground level as well as the ability to close automatically in response to abnormal rapid flow.

To avoid the foregoing and other limitations and shortcomings of prior safety cut-off valve constructions, there is provided by U.S. Pat. No. 4,002,202 issued to Huebsch and Paulos an improved safety cut-off valve having an electromagnetic operating mechanism controllable from the surface by power leads extending along the tubing annulus. The operating mechanism functions equally well to open either a flapper or ball-type valve. The cut-off valve assembly functions in a highly satisfactory manner at any desired depth, the valve-opening operation being facilitated at greater depths by first equalizing the pressure on the opposite sides of the valve from ground in accordance with techniques well known to those skilled in this art. The valve assembly, with the exception of the solenoid coil subassembly, is installable and retrievable by wire line operating techniques or alternatively by retrieving all or part of the tubing string. The solenoid coil must be energized to open the flow control member and to hold it open. If power fails for any reason or is deliberately cut off, spring means, acting alone or in cooperation with flow past the valve quickly closes the valve and positively prevents further flow. Additionally, both species of this improved safety cut-off valve close automatically if flow increases abnormally for any reason.

However, our aforedescribed safety valve is subject to certain limitations. For example, many wells are so constructed that there is not unlimited space between the tubing string and the well casing. This is especially true as respects certain tubing retrievable valves in which the tubing string bore through the valve mechanism is the same as that of the tubing string and this unadvoidably increases the outside valve diameter over that of wire line type valves. Due to valve construction and operating characteristics there are numerous limitations confronting the designer difficult to resolve when using solenoids to operate the valve.

SUMMARY OF THE INVENTION

The foregoing and other shortcomings are circumvented by this invention wherein a safety cut-off valve of either the flapper or ball type is provided with a unique tandem solenoid operator. The radially shallow coils embrace the exterior of the flow path and cooperate in energizing a like number of aligned tubular armatures to open the safety cut-off valve in opposition to a compression spring effective to assure valve closure in the event of any of a variety of conditions. An abundance of valve operating power is assured by virtue of reliance on a plurality of solenoids in mutually assisting tandem relation and this permits the use of coils of minimum thickness readily accommodated in the well annulus of virtually any conventional well without posing installation and service problems. Extra valve operating power when needed for larger diameter tubing strings is obtainable by utilizing tandem solenoids so spaced as to move tandem armature sections to their respective retracted positions in sequential cascade fashion such that each solenoid contributes sequentially to the valve opening cycle. These respective techniques make it feasible to provide ample valve opening power as well as valve closing spring means of fully adequate strength.

Another feature of the invention is the use of efficient and reliable means aiding in holding the valve open with very substantially reduced power to the solenoid coils and comprising either separate magnetic pole pieces for each of the tandem armatures or, alternatively, one or more clutches designed to engage the valve operating means and supplement the power of the energized coils. Either mode of restraining valve return makes it feasible to employ substantially less electrical power to hold the valve open than that useful to open the valve. This not only represents a major energy saving but, more importantly, it renders the valve more quickly responsive to emergencies. Moreover, in all embodiments the tubing string is free of perforations or passages of any kind for electrical conductors or pressurized fluids heretofore commonly relied upon in the operation of prior safety valves.

Yet another feature is a principal safety cut-off valve so designed as to permit the installation of a secondary or substitute safety valve via wireline without need for disturbing the disabled principal valve or the tubing string. The substitute safety valve is installable through the existing valve and includes means to block the disabled valve in open position and with the new valve operatively associated with a standby solenoid coil present on the tubing string when initially installed.

Accordingly, it is a primary object of the present invention to provide an improved sub-surface safety cut-off valve of the normally closed type powered by tandem solenoids controlling opening and retaining the valve in open position so long as the solenoids are energized.

Another object of the invention is the provision of a fail-safe sub-surface safety cut-off valve for a petroleum well having electrically powered tandem means for opening and retaining the same in open position.

Another object of the invention is the provision of a fail-safe cut-off valve for installation at substantially any selected sub-surface depth and provided with surface-controlled electrically powered means for controlling operation of the valve rather independently of fluid pressure auxiliaries.

Another object of the invention is the provision of both wire line and tubing retrieval safety valves of the flapper and ball type and operable to open position by a compound tubular armature or plunger energized by tandem solenoid coils.

Another object of the invention is the provision of a safety valve installable via wireline as a substitute for an installed but disabled safety valve without need for the removal of the tubing.

Anoher object of the invention is the provision of an improved safety cut-off valve employing multiple solenoid coils spaced axially apart and operatively associated with respective tubular plungers and operatively connected to a common cut-off valve normally biased to closed position.

Another object of the invention is the provision of a safety cut-off valve utilizing tandem solenoids in combination with tandem armature sections cooperating to open the cut-off valve and to move to their respective retracted positions sequentially cascade fashion.

Another object of the invention is the provision of a safety cut-off valve equipped with tandem solenoids and tandem armature sections movable sequentially to their respective retracted positions and each contributing an aliquot share and with maximum effectiveness in opening the cut-off valve and in stressing the armature return spring.

Another object of the invention is the provision of a cascade tandem solenoid device usable to actuate a device with maximum power as their cascaded solenoid armatures move sequentially to their respective retracted positions.

These and other more specific objects will appear upon reading the following specification and claims and upon considering in connection therewith the attached drawings to which they relate.

Referring now to the drawing in which a preferred embodiment of the invention is illustrated:

Figure 5A:
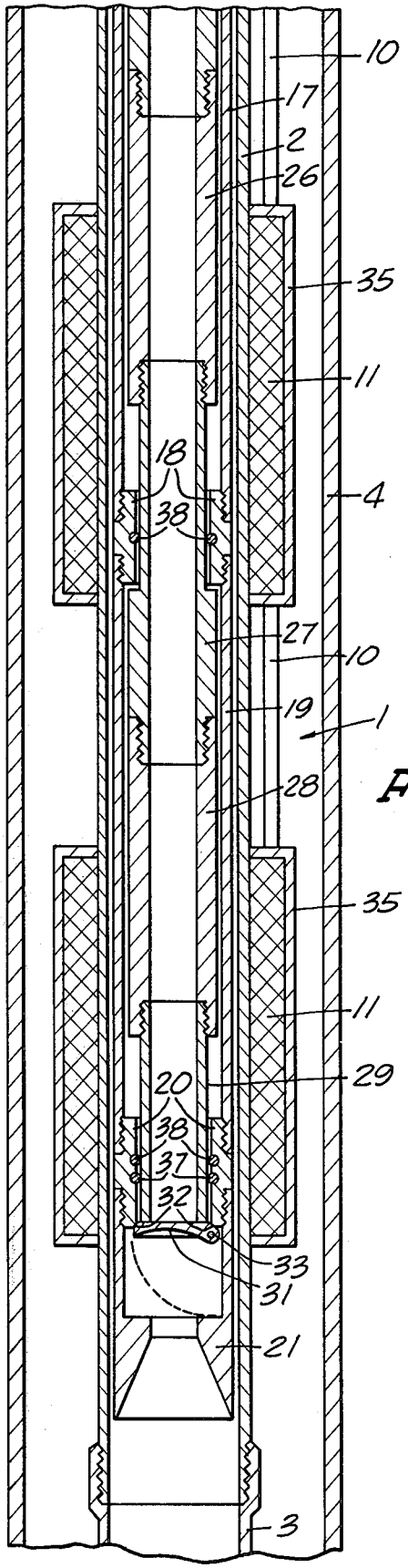
Figure 5B:
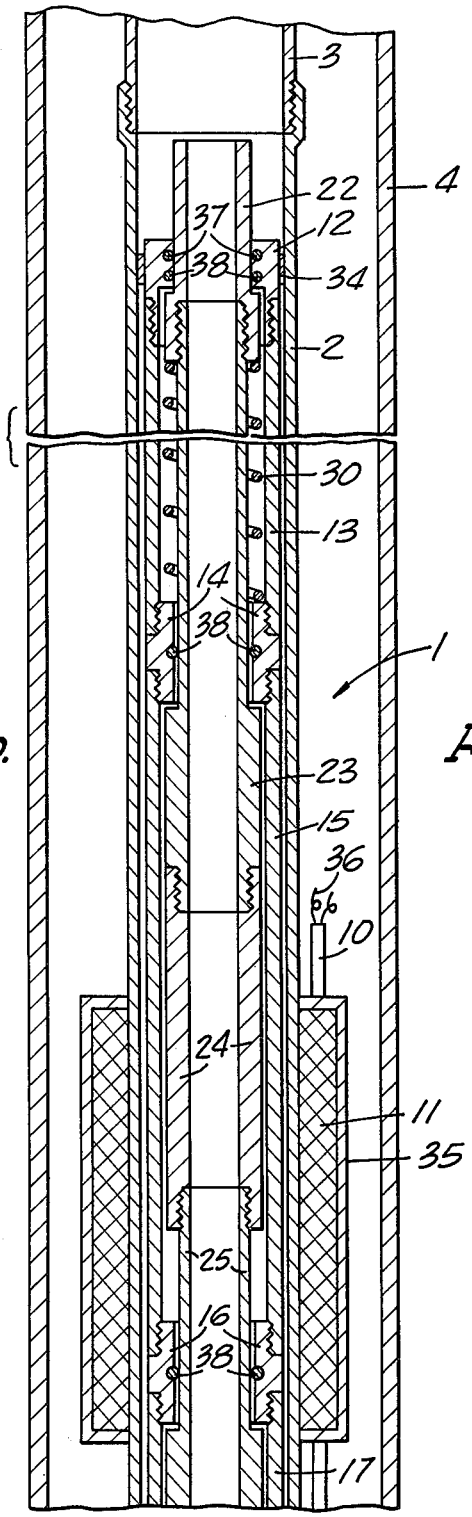

FIG. 5*a* is a longitudinal cross-sectional view showing a wire line retrievable flapper valve embodiment of the invention in closed position;

FIG. 5*b* is the upper extension of the valve shown in FIG. 5*a;*

Figure 6A:
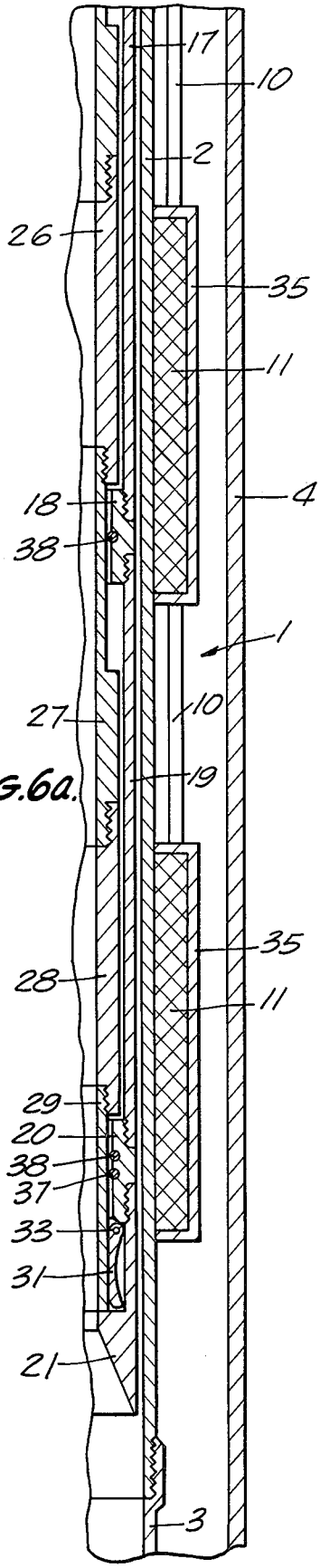
Figure 6B:
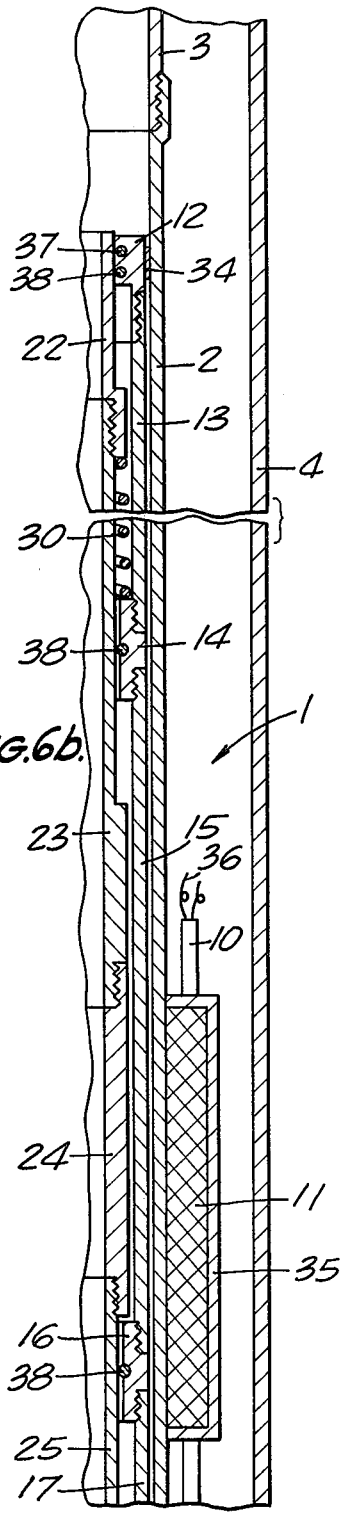

FIG. 6*a* is a view similar to FIG. 5*a* taken along the right-hand half of FIG. 5*a* but showing the valve open;

FIG. 6*b* is the upper extension of the valve shown in FIG. 6*a;*

Figure 7A:
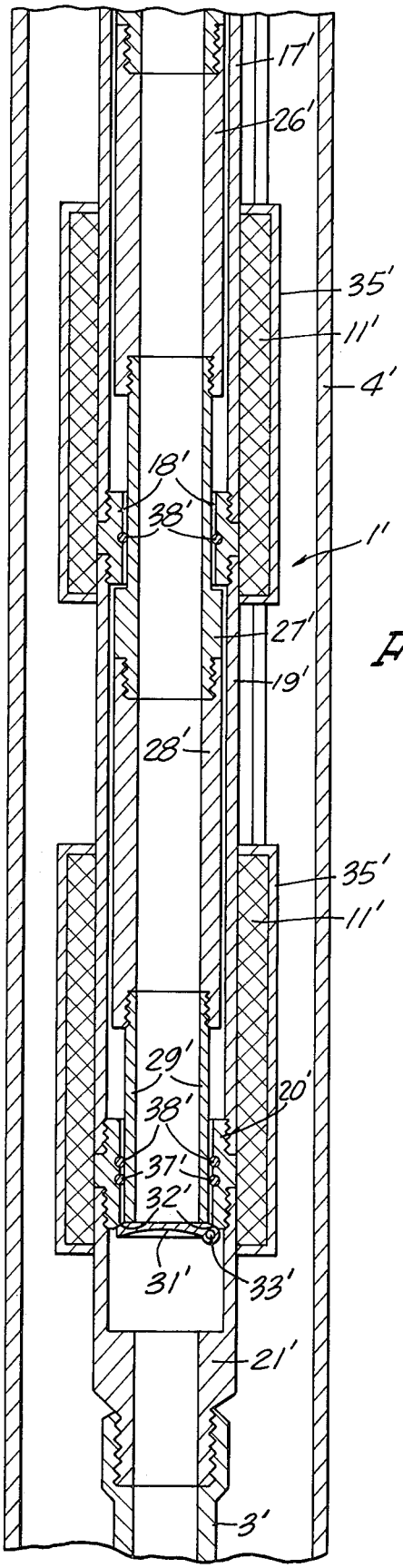
Figure 7B:
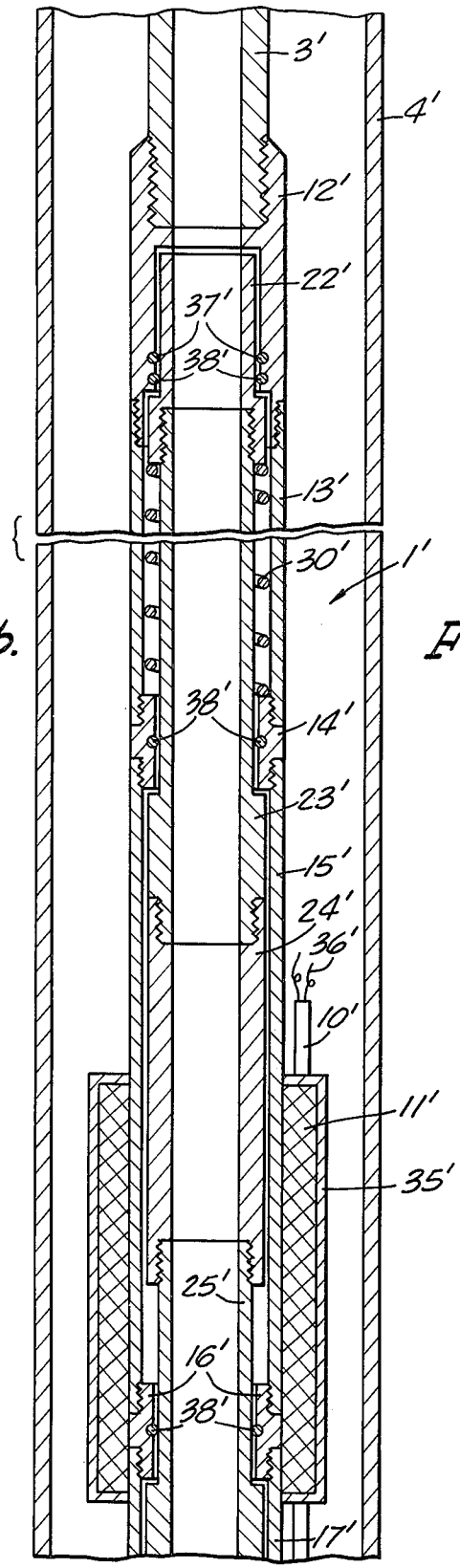

FIG. 7*a* is a longitudinal cross-sectional view showing a tubing retrievable flapper valve embodiment of the invention in closed position;

FIG. 7*b* is the upper extension of the valve shown in FIG. 7*a;*

Figure 8A:
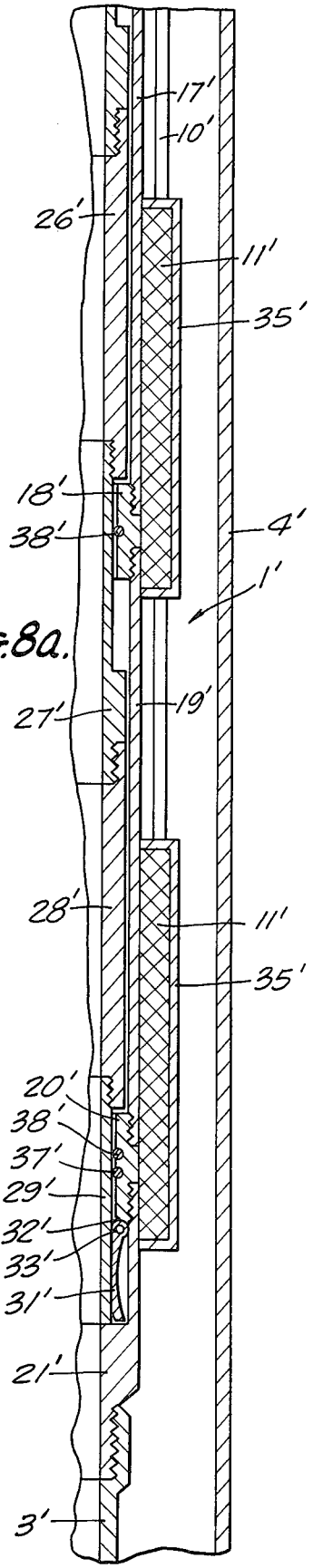
Figure 8B:
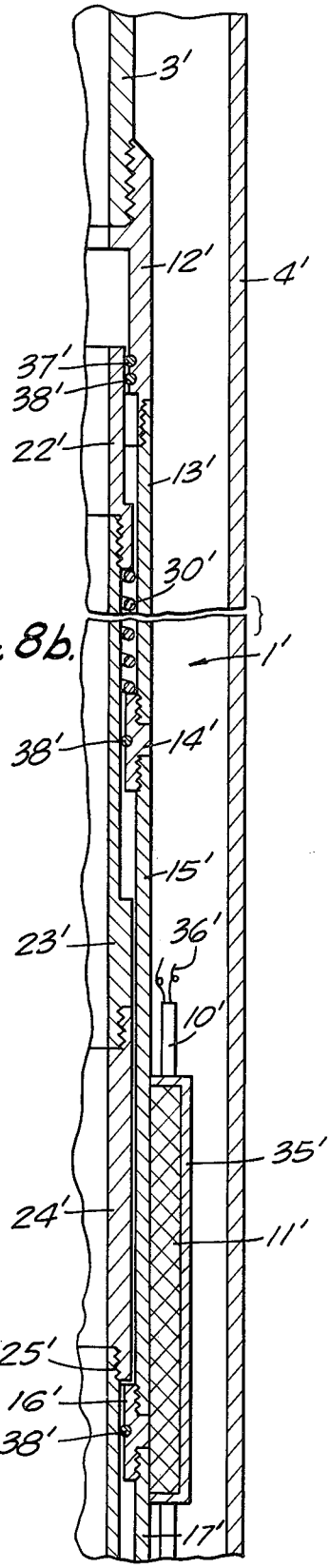

FIG. 8*a* is a view similar to FIG. 7*a* taken along the right-hand half of FIG. 7*a* but showing the valve open;

FIG. 8*b* is the upper end of the valve shown in FIG. 8*a;*

Figure 9A:
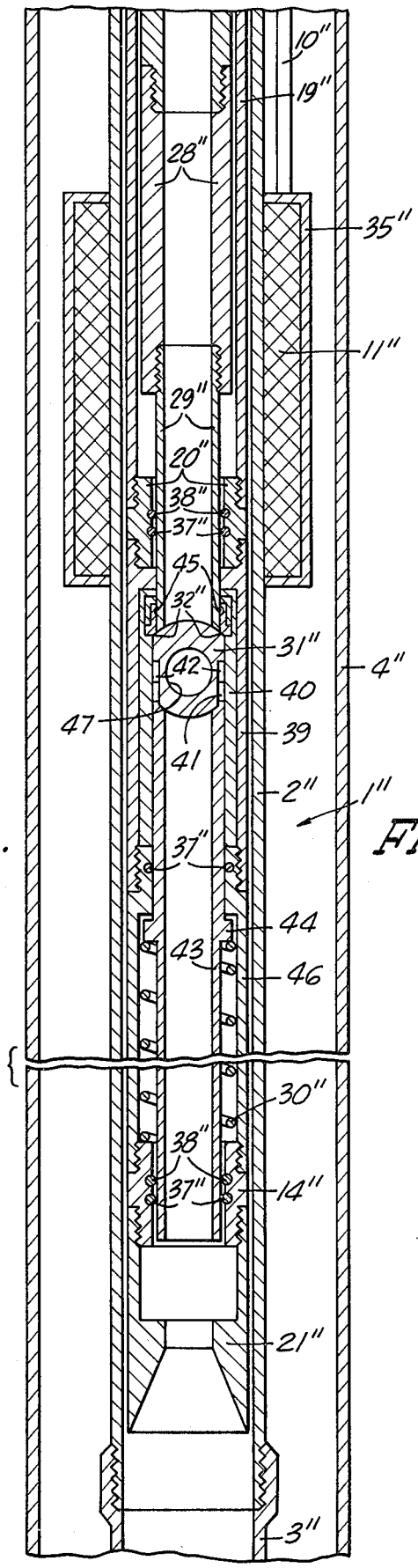
Figure 9B:
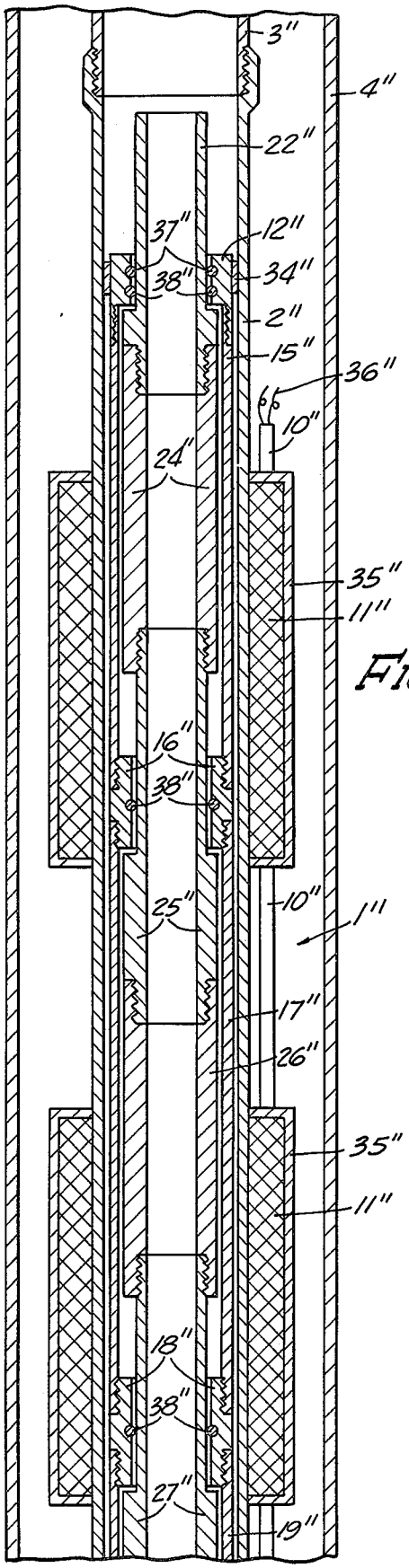

FIG. 9*a* is a longitudinal cross-sectional view showing a wire line retrievable ball valve embodiment of the invention in closed position;

FIG. 9*b* is the upper extension of the valve shown in FIG. 9*a;*

Figure 10A:
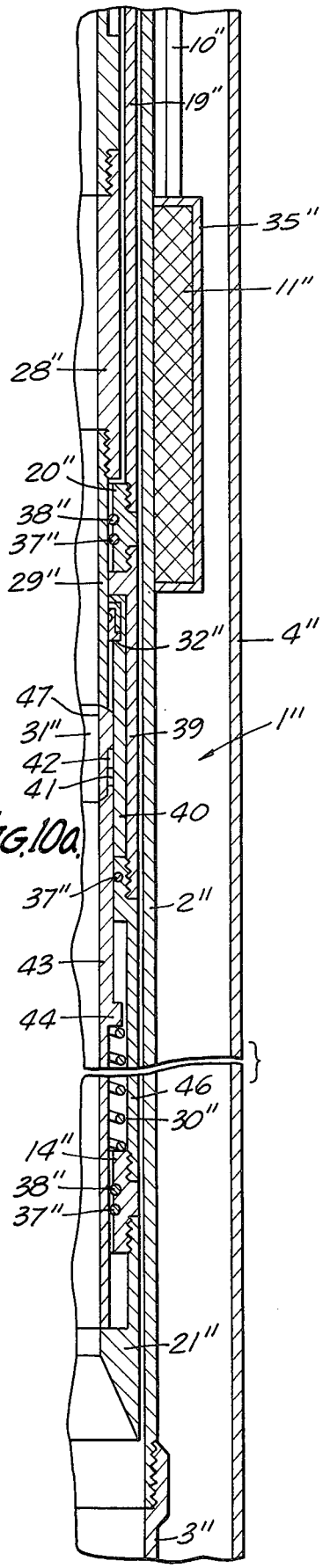
Figure 10B:
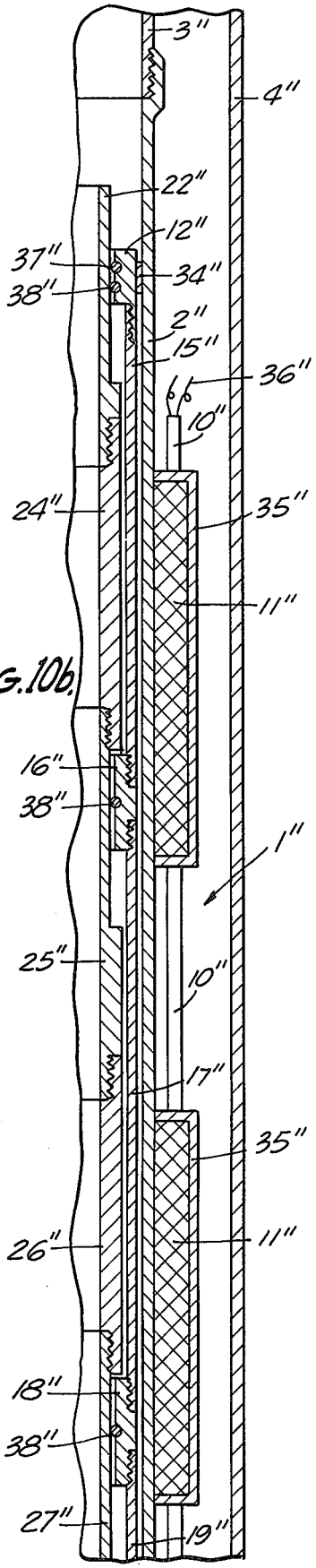

FIG. 10*a* is a view similar to FIG. 9*a* taken along the right-hand half of FIG. 9*a* but showing the valve open;

FIG. 10*b* is the upper extension of the valve shown in FIG. 10*a;*

Figure 11A:
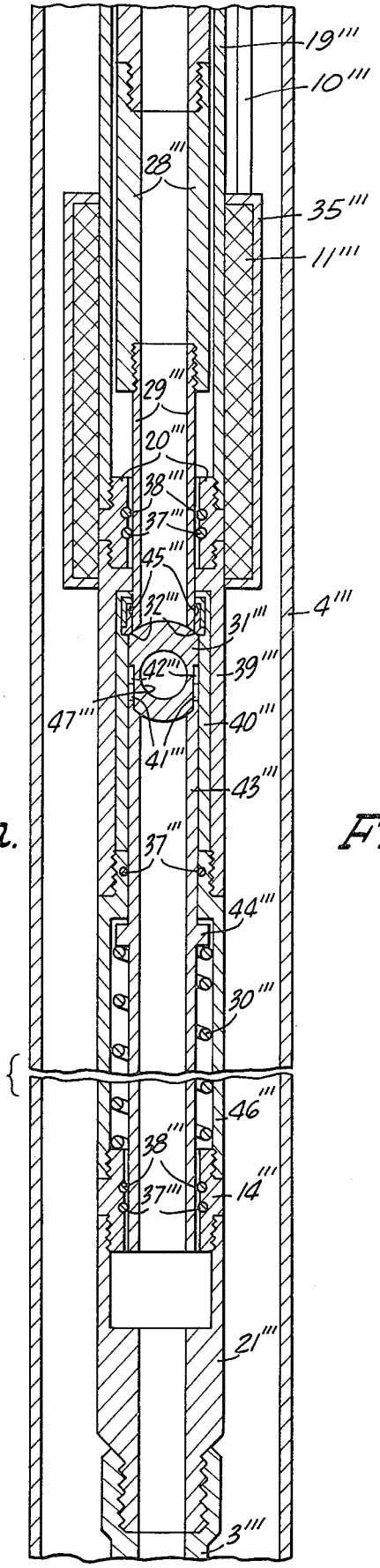
Figure 11B:
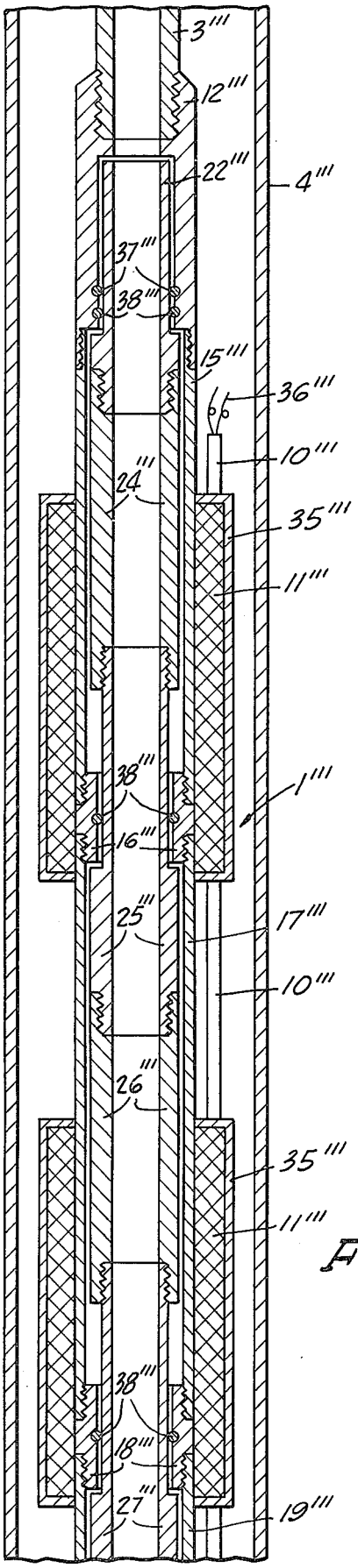

FIG. 11*a* is a longitudinal cross-sectional view showing a tubing retrievable ball valve embodiment of the invention in closed position;

FIG. 11*b* is the upper extension of the valve shown in FIG. 11*a;*

Figure 12A:
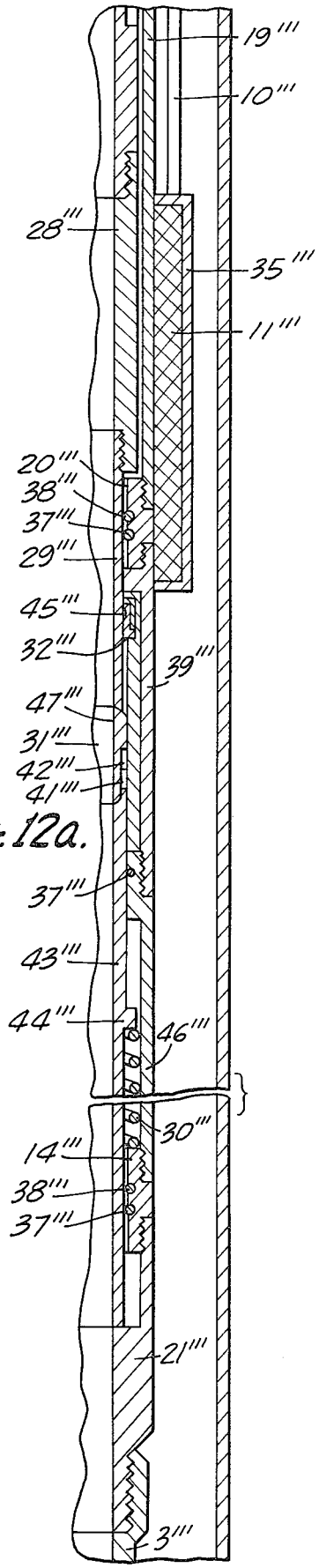
Figure 12B:
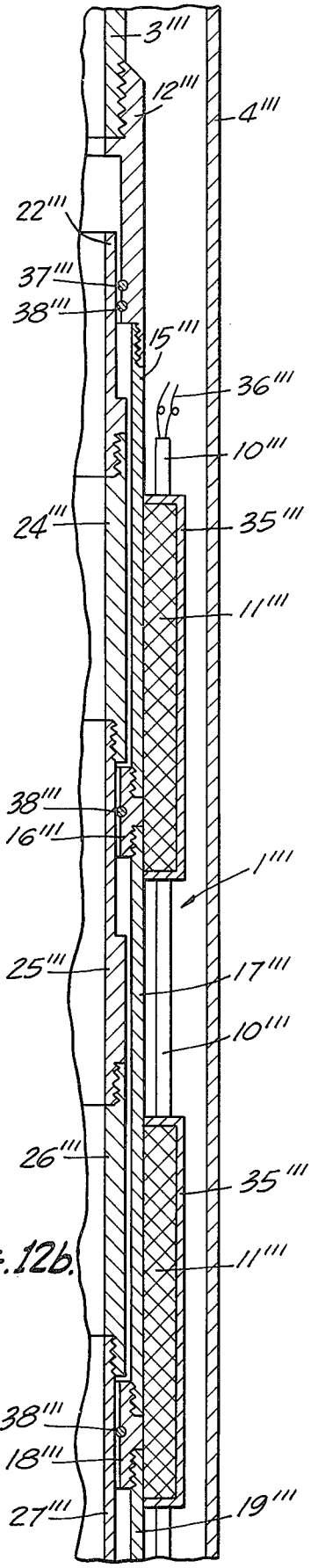

FIG. 12*a* is a view similar to FIG. 11*a* taken along the right-hand half of FIG. 11*a* but showing the valve open;

FIG. 12*b* is the upper extension of the valve shown in FIG. 12*a;*

Figure 13:
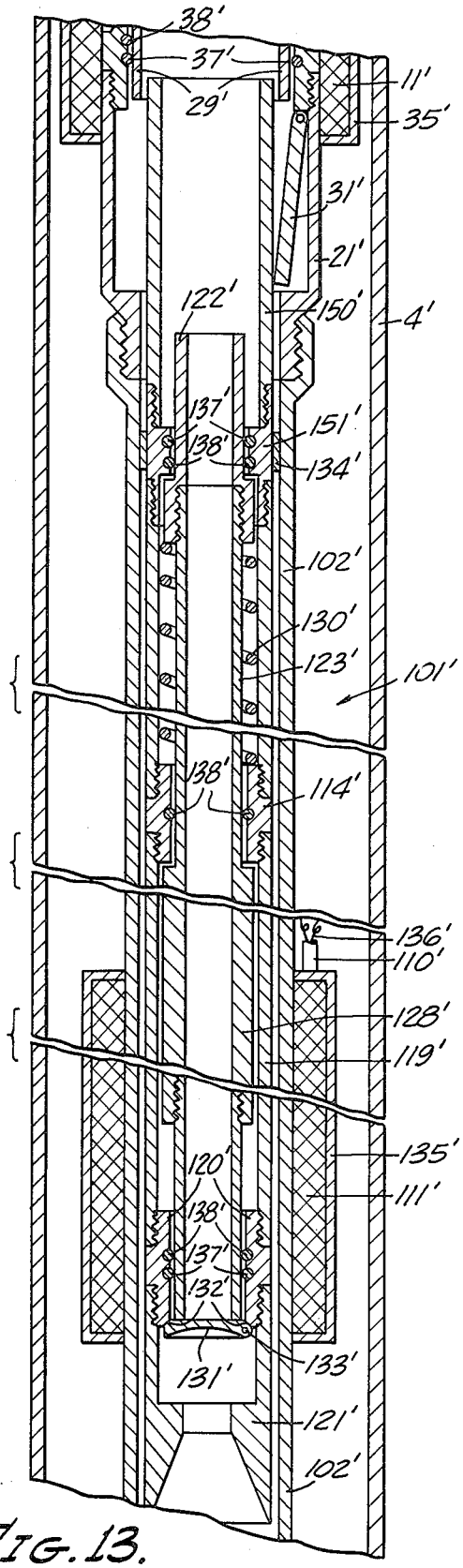
Figure 14:
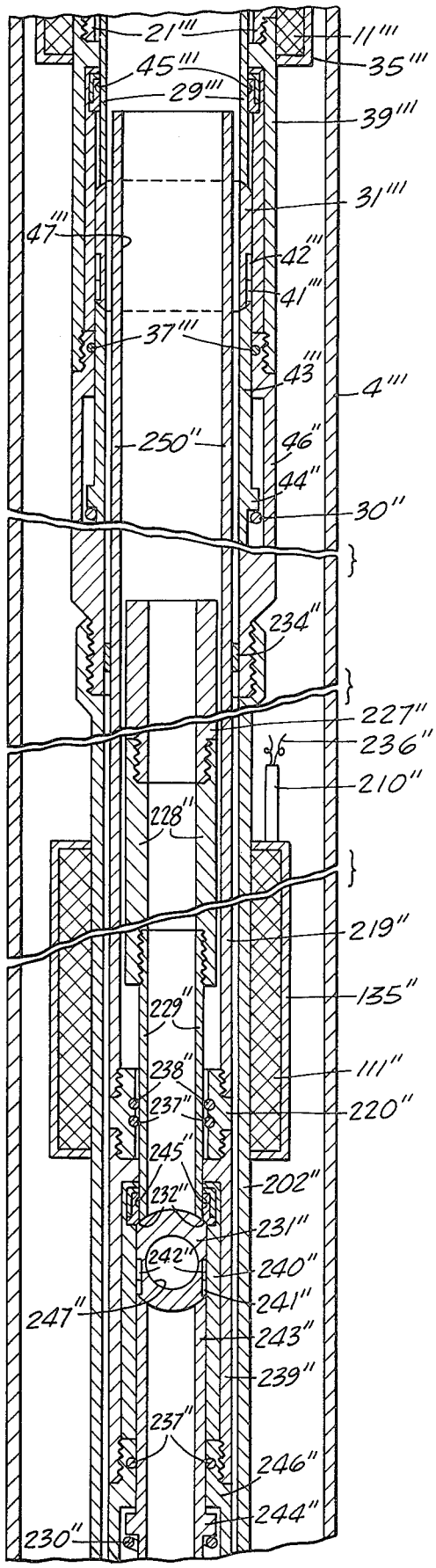
Figure 15:
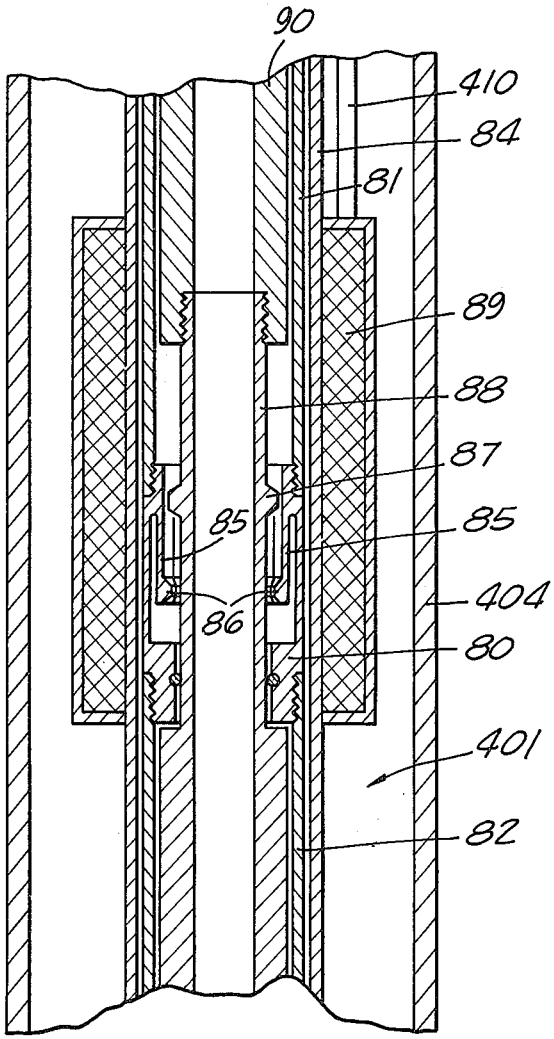
Figure 16:
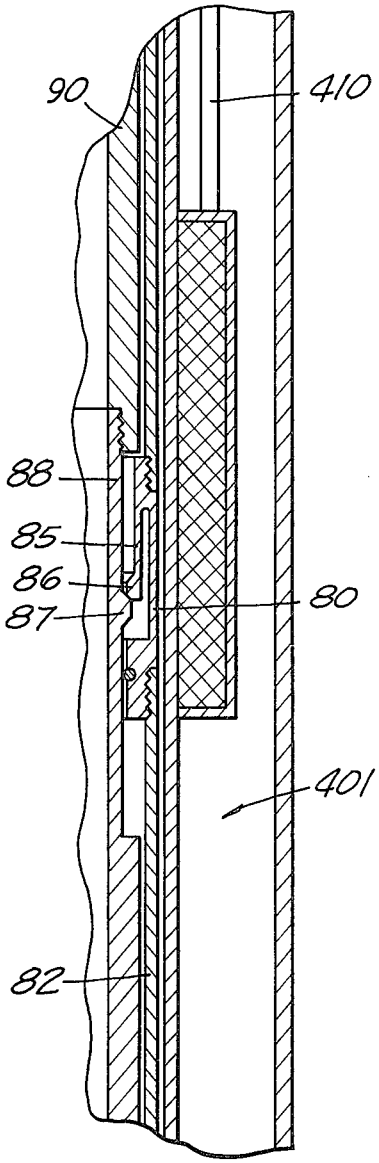
Figure 17:
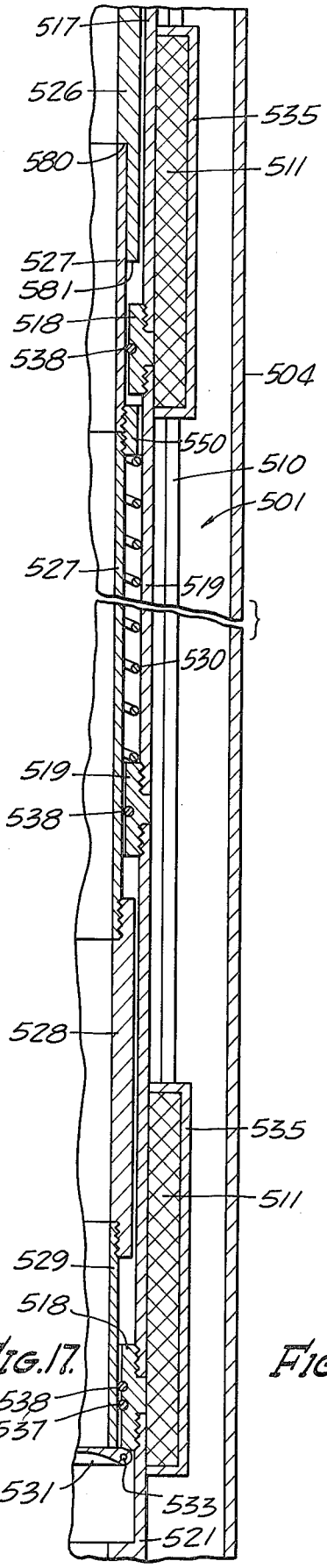
Figure 18:
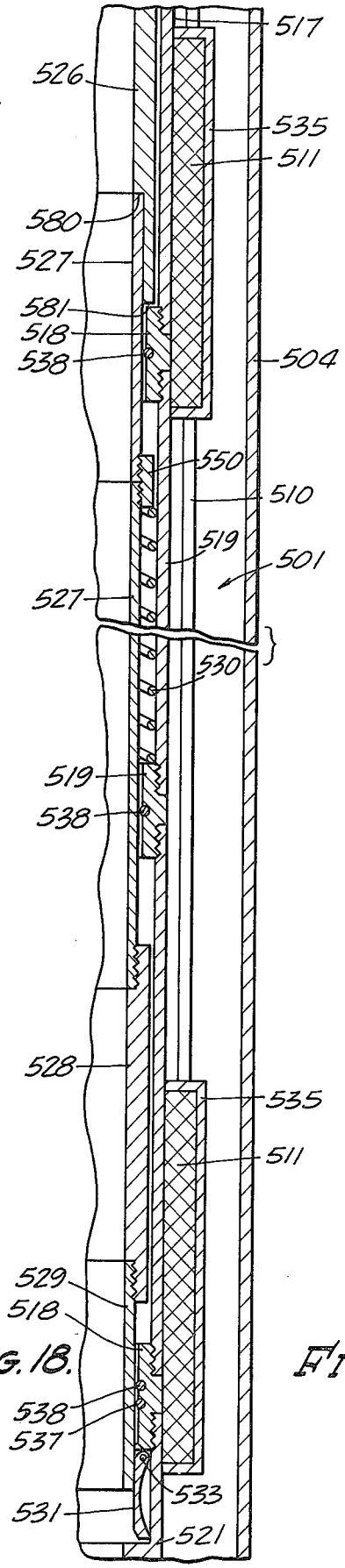
Figure 19:
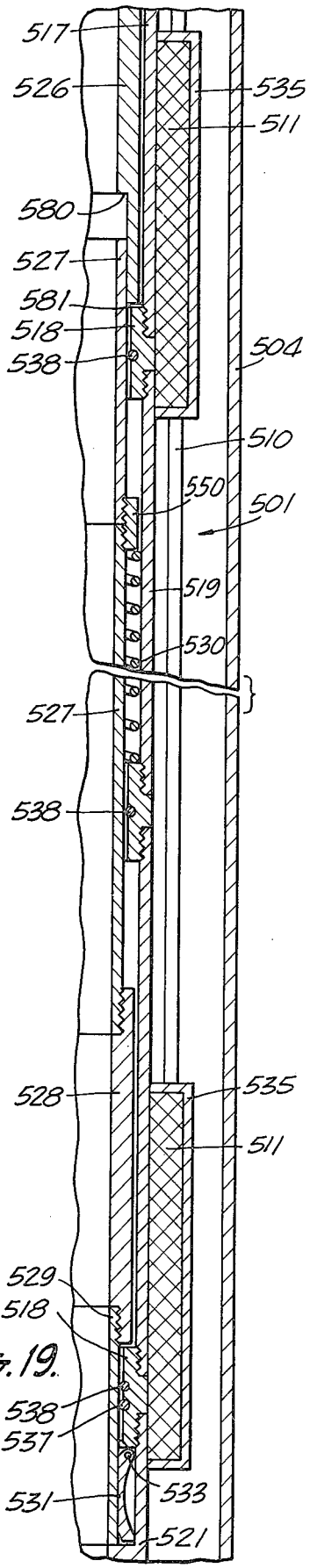

FIG. 13 is a longitudinal cross-sectional view showing the valve portion of a tubing retrievable flapper valve locked in the open position by a wire line retrievable flapper valve shown in the closed position;

FIG. 14 is a longitudinal cross-sectional view showing the valve portion of a tubing retrievable ball valve locked in the open position by a wire line retrievable ball valve, shown in the closed position;

FIG. 15 is a longitudinal cross-sectional view showing a mechanical mechanism usable in lieu of magnetic pole pieces to assist the solenoid in holding any of the above disclosed valves open and shown with the armature fully extended; and FIG. 16 is a view similar to FIG. 15 taken along the right hand half of FIG. 15 but showing the mechanical clutching mechanism holding the armature in its retracted position to hold the valve open;

FIG. 17 is a cross-sectional view of the right hand half of another embodiment of a tubing retrievable tandem safety cut-off valve having a telescoping tandem armature showing the flapper valve closed;

FIG. 18 is a view similar to FIG. 17 but showing the valve closing spring partially compressed and the lower armature section partially retracted; and FIG. 19 is a view similar to FIG. 17 but showing the valve open and both armature sections fully retracted.

Figure 1:
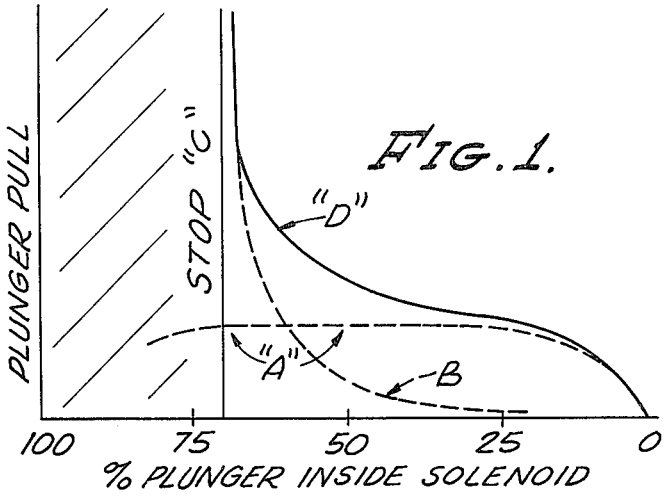
FIG. 1 is a graphical representation of the pulling strength of a solenoid armature with and without a magnetic stop.

Referring to FIG. 1 and assuming that the armature plunger is equal in length to a solenoid coil lacking a magnetic stop, the pulling force "A" is exerted by the plunger when the solenoid is energized. It can be seen that the pulling force "A" reaches a maximum when the plunger is approximately 30% inside the solenoid coil and continues at an approximate equal pulling force until the plunger is approximately 70% within the solenoid when the pulling force (dotted curve) starts to drop off, reaching zero pulling force when the plunger is centered lengthwise of the solenoid. Without a magnetic stop within the solenoid, the 30% to 70% range is therefore the distance through which the plunger performs its maximum work.

However, when a pole piece "C" of magnetic material is inserted within one end of the solenoid, the pole piece and the plunger are mutually attracted and this produces an additional pulling force "B" on the plunger. As the plunger approaches the pole piece "C", the pulling force "B" increases approximately inversely with the distance between the two poles when the plunger is saturated with magnetic flux. The pulling force "B" is additive to and eventually becomes predominant over initial pulling force "A" reaching a maximum when the plunger pole face is in contact with the pole piece "C". Therefore, the solenoid ampere turns for a given static holding force may be substantially reduced below that required without the pole piece (curve "A"). Curve "D" illustrates the sum of pulling forces "A" and "B".

Figure 2:
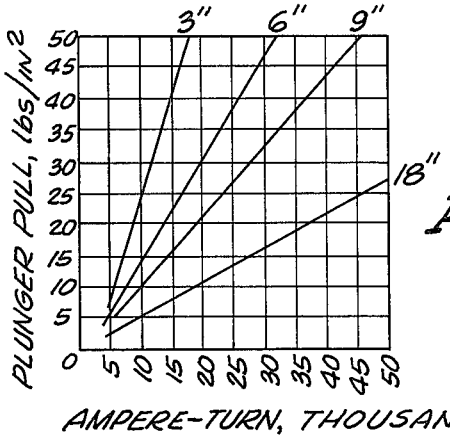
FIG. 2 is a graphical representation of the plunger strength as a function of solenoid ampere-turns and solenoid length.

FIG. 2 graphically depicts the pulling force created by solenoids of various lengths on plungers having equal cross-sectional areas as a function of ampere-turns. Solenoids having lengths of 3, 6, 9, and 18 inches are shown. It can be seen that a solenoid 18 inches long having 45,000 ampere-turns produces a pulling force of 25 pounds per square inch whereas a solenoid having half that length provides the same pulling force of 25 pounds per square inch while having only half the ampere-turns of 22,500.

It can also be seen from inspection of FIG. 2 that the pulling force of a solenoid varies inversely with coil length when the ampere turns remain constant. Hence, the pulling force in a solenoid is proportional only to the ampere-turns per unit length of coil winding. This invention makes use of this basic principle to provide a high power solenoid actuator with radially shallow windings by employing separate solenoids in tandem with their tubular plungers operating in unison through non-magnetic tubular couplings and serving additionally as the fluid flow passage. This arrangement utilizes readily available vertical space advantageously with minimum and readily acceptable demands on well annulus space surrounding the tubing string.

Figure 3:
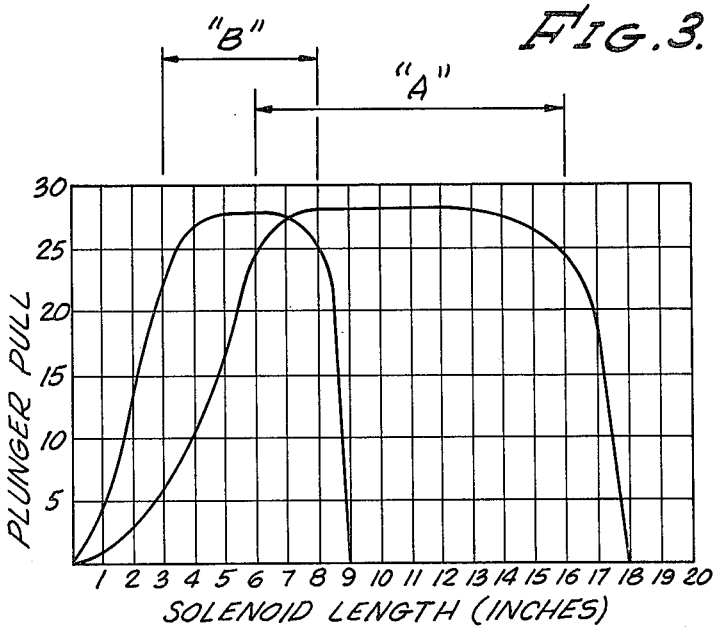
FIG. 3 is a graphical representation of the plunger pulling stroke as a function of solenoid length.

FIG. 3 illustrates the effective pulling stroke of the armature as a function of solenoid length, the effective stroke A being twice the effective stroke B.

Figure 4:
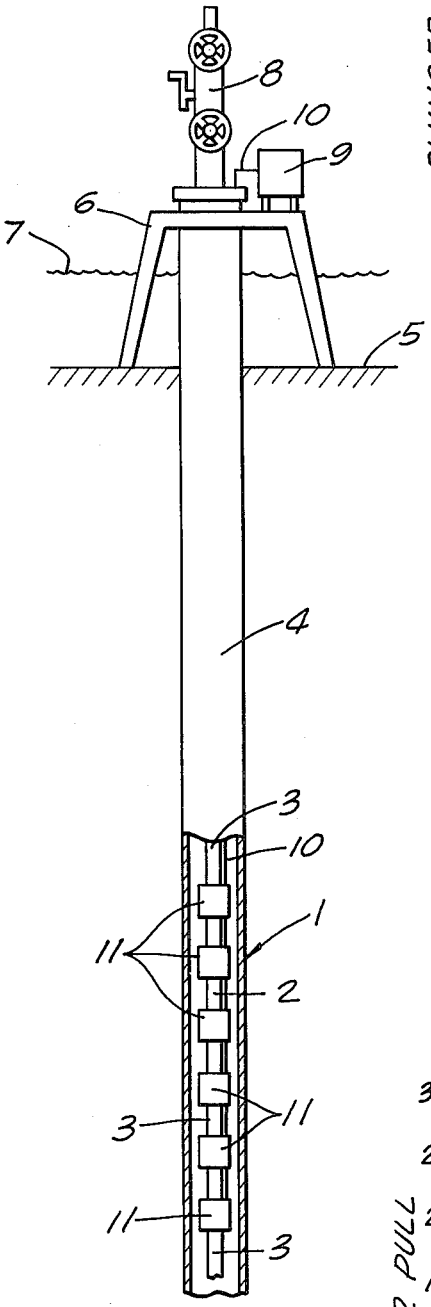
FIG. 4 is a diagrammatic view, partly in cross-section, showing a petroleum well equipped with an illustrative embodiment of the invention cut-off valve powered by tandem solenoids.

Referring to FIG. 4, there is shown a typical well equipped with one embodiment of the invention safety cut-off valve designated generally 1 installed in a landing nipple 2 interconnecting the adjacent ends of tubing string sections 3 to either end of the landing nipple. The tubing string extends through the usual casing 4 extending through sea bed 5 to an operating platform 6 supported in any suitable manner above the water surface 7. The top of the well casing is provided with the customary Christmas tree 8. Located on platform 6 is a d.c. power source 9 supplying power via cable 10 to the tandem solenoids 11 embracing and suitably fixed to the landing nipple 2.

Referring now to FIGS. 5*a*, 5*b*, 6*a* and 6*b* the construction details of a flapper type, wire line retrievable safety cut-off valve sub-assembly will be described. Certain components are made of magnetic material, others are made of non-magnetic material, and still others may be optionally of magnetic or non-magnetic material.

The retrievable cut-off valve sub-assembly comprises a tubular housing formed in several non-magnetic coaxial sections threaded to one another via magnetic stop sections including an optional material upper sleeve 12, non-magnetic section 13, non-magnetic stop 14, non-magnetic section 15, magnetic stop 16, non-magnetic section 17, magnetic stop 18, non-magnetic section 19, lower magnetic stop 20, non-magnetic section 21. Reciprocally supported in this housing is a tubular plunger or armature subassembly comprising several armatures interconnected tandem-fashion by several non-magnetic tubular sections. This subassembly includes an optional material stop section 22, non-magnetic sections 23, 25, 27, 29 and magnetic armatures 24, 26, and 28. The subassembly is normally urged upwardly by a spring 30 thereby permitting non-magnetic flapper valve 31 to close against seat 32. Valve 31 is pivotally supported on inlet member 21 by a pivot pin 33 and is biased to closed position by a suitable spring, not shown.

The aforementioned tubular housing is detachably supported within non-magnetic landing nipple 2 by a fluid-tight seal and coupling assembly 34 of construction well known to persons skilled in this art. For example, this coupling may be of the type in which the portion fixed to the upper end of the tubular housing can be securely locked assembled to the landing nipple by a suitable connector which is readily engaged and disengaged by a conventional wire line tool lowered through tubing string 3.

Surrounding landing nipple 2 are shown a plurality of solenoid coils 11 located radially opposite non-magnetic sections of the tubular valve housing and radially opposite associated ones of the magnetic armatures and stops. A plurality of solenoids are shown for illustrative purposes the three lowermost ones in FIG. 4 being installed for a purpose to be described below. Depending on the required valve operating forces and well configuration, either two solenoids or more than three may be utilized. Coils 11 are enclosed in optional material casings 35 for protective purposes. Connecting the solenoids and extending from the top solenoid to the well head is a cable 10 enclosing electrical conductors 36 connected at the well head to the d.c. power supply 9. As is clearly evident from the drawings, the solenoids and their casings are sealed to the exterior of the landing nipple in the well annulus between tubing string 3 and well casing 4.

The armatures or plungers 24, 26 and 28 and magnetic stops 16, 18 and 20 cooperate with their respective solenoid coils in providing an excellent low reluctance flux path for the flux generated by coils 11 when these are energized. The upper ends of the magnetic stops 16, 18 and 20 form stationary pole pieces against which the lower end of armatures 24, 26 and 28 seat and are held restrained and firmly captive. At such times the flapper valve 31 is not only held in the open position, but both this valve and its seat 32 are shielded from the fluid flow by section 29. When the coils are de-energized the compression spring 30 cooperates with upper stop 14 and section 22 to elevate the armature sub-assembly vertically above the valve seat 32 thereby allowing the flapper cut-off valve 31 to close, this valve being biased toward closed position by a torsion spring not shown.

Before opening the valve it may be necessary to equalize the pressure on the opposite sides of the valve, an operation accomplished from the operating platform 6 in well known manner by operating valves and equipment to pressurize the tubing string until pressure equalization is obtained. Thereupon the operator restores the power supply 9 to the solenoid coils 11 via cable 10 and leads 36, the resulting flux generated by the coils then being effective to lower the tandem armature subassembly against the associate pole piece stops 16, 18 and 20. As the armatures move downwardly, spring 30 is compressed and valve 31 is pivoted counter-clockwise to the open position through contact with the lower end of lower section 29 and is held fully open until the solenoids are de-energized. Optional oil seals 37 embracing the opposite ends of the armature subassembly safeguards against fluid and foreign matter entering the surrounding chamber which contains a captive charge of clean fluid. Bearing surfaces 38 prevent the armature subassembly from binding due to the high magnetic flux operating on them, and are preferably made of non-magnetic material.

As soon as the valve is fully open the operator may discontinue pressurizing the upper end of the tubing, open the valves controlling production flow from the well and reduce the surface d.c. power to a predetermined value. Flow takes place in the normal manner through the production flow passage which includes the tubular tandem armature subassembly.

The safety cut-off valve may be closed either by cutting off the power to the solenoid coil or by an abnormal increase in the flow through the valve. Thus, it will be understood that the valve will also close if pressure differential at the opposite ends of the tandem armatures exceed a predetermined value. For example, flow at a rate above that for which a particular cut-off valve is designed will increase the friction flow losses of the armature subassembly. These forces plus the energy stored in spring 30 will exceed the magnetic holding power of the safety valve with the result that valve 31 will close. The pressure differential effective to cause the valve to close may be adjusted over a substantial range by varying the direct current voltage applied to the solenoid coils.

Referring now to FIGS. *7a, 7b, 8a* and *8b*, there is shown a second preferred embodiment of the invention utilizing a flapper type, tubing retrievable safety cut-off valve. The same or similar parts of the second embodiment are designated by the same reference characters employed above in connection with FIGS. *5a, 5b, 6a* and *6b* and are constructed of the same magnetic, non-magnetic or optional magnetic or non-magnetic materials. The same or similar components are identified by the same reference characters used in describing FIGS. *5a, 5b, 6a,* and *6b* but are distinguished therefrom by a prime. In all major respects these two embodiments are similar and operate similarly but the modified safety valve is not wire line retrievable but can be serviced only by withdrawing the tubing string to expose the valve at the well head. In this version, the wire line retrievable portion of the valve housing present in the first described embodiment serves additionally in the second embodiment as the landing nipple interconnecting the sections of the tubing string to either end of the safety cut-off valve 1'. Hence this landing nipple becomes the support for the tandem solenoid coils. The wireline disconnect 34 is also not present for obvious reasons.

Referring now to FIG. *9a, 9b, 10a,* and *10b*, there is shown a third preferred embodiment of the invention utilizing a ball-type wireline retrievable safety cut-off valve element arranged to be operated between its closed and open positions by the above described tandem solenoid means. The same or similar parts of the third embodiment are designated by the same reference characters employed above in connection with FIGS. *5a, 5b, 6a,* and *6b* but are distinguished therefrom by a double prime. In all major respects these two embodiments are constructed in the same general manner and operate similarly with the exception that the non-magnetic ball valve element 31" is constructed and mounted quite differently from the flapper valve 31. Also in the interests of brevity the construction details of the valve cage supporting ball valve 31" have not been shown in full since these components are well known and fully disclosed in U.S. Pat. No. Re. 28,131 granted to Leutwyler on Aug. 20, 1974. Valve 31" is supported in a two-part non-magnetic cylindrical valve cage 40, within non-magnetic tubular section 39 embracing this ball valve and having a pair of non-magnetic trunnions 41 projecting toward one another into V-shaped notches 42 formed in the diametrically opposed sides of valve 31". The axes of trunnions 41 are offset below the center of ball valve 31" and are arranged to rotate valve 31" through 90° about a horizontal axes as the tandem armature subassembly 24", 26" and 28" reciprocates between its fully retracted and extended positions. It will be understood that this operating range of movement of the armatures is similar to the range of armature movement in FIGS. *5a, 5b, 6a,* and *6b*. The valve seat 32" is located at the lower end of armature section 29" and bears directly against the upper surface of the ball. The ball is urged to rotate upwardly toward seat 32" by a non-magnetic underlying tube 43 having a loose sliding fit with the lower half of the valve cage 40 and is biased against the underside of the ball by the compression spring 30". The upper end of this spring bears against a radial flange 44 surrounding tube 43 whereas its lower end rests on stop 14". Cooperating with valve seat 32" and the upper side of ball 31" is a sealing ring 45 of any suitable material.

Normally, with the solenoid coils 11" deenergized, spring 30" urges the tubular inlet members 43, ball valve 31" and armatures 24", 26", and 28" upwardly along the interior of the tubular housing 15", 17", 19", 39, and 46. Valve cage 40 will be understood as held stationary between shoulder components 39 and non-magnetic 46. When the parts are positioned as illustrated in FIG. *9a*, ball 31" is rotated 90° to its closed position as shown in FIG. *10a* and is held firmly seated against seat 32" and the seat sealing ring assembly 45.

To open the valve, the operator proceeds much in the same manner described above in connection with the first embodiment. Usually there is a pressure differential across the valve when closed and this differential should be equalized by pressurizing the upper end of the tubing string 3" in well known manner. This having been done, the operator energizes the solenoid coils to generate a powerful flux stream through the solenoids 11", the armatures 24", 26", 28", and their respective magnetic stops 16", 18" and 20". When first energized, valve 31" is at its elevated closed position. The magnetic forces provided by the flux pulls the tandem armatures toward their respective magnetic stops. As the armatures are drawn closer to the stops the magnetic forces increase until they reach a maximum when the armatures are in contact with their respective magnetic stops. Accordingly, the lower section 29'', the ball valve 31'' and tubing 43 are moved axially downwardly compressing spring 30''. During the downward movement trunnions 41 cooperate with V-shaped notches 42 in the sides of ball 31'' to rotate this ball 90° to its open position wherein its diametric bore 47 is axially aligned with the flow passages through inlet tubing 43 and the armatures.

The valve assembly remains open to provide unobstructed flow so long as the solenoid coils remain energized or until the differential pressure across the cut-off valve exceeds a predetermined value in which event the valve will close automatically as explained in detail above in connection with the valve illustrated in FIGS. 5*a*, 5*b*, 6*a*, and 6*b*.

Referring now to FIGS. 11*a*, 11*b*, 12*a*, and 12*b*, there is shown a fourth preferred embodiment of the invention utilizing a ball-type tubing retrievable safety cut-off valve 1'''. The same or similar parts of the second embodiment are designated by the same reference characters employed above in connection with the third embodiment, FIGS. 9*a*, 9*b*, 10*a*, and 10*b* but are distinguished therefrom by a triple prime. In all major respects these two embodiments are constructed in the same general manner and operate identically with the exception that the wire line retrievable portion of the valve housing present in the valve subassembly of the third embodiment serves additionally in the fourth embodiment as the landing nipple and is embraced by and supports the tandem solenoid coils 11'''. In addition, and as herein shown, the flow passages including the armatures, inlet tubing and ball bore of the fourth embodiment have the same bore diameter as the tubing string. Servicing of the cut-off valve therefore requires that the tubing string be pulled and removed to and including the cut-off valve.

It may be desirable to convert a tubing retrievable safety valve system to a wire line retrievable safety valve system without removing the tubing string. Referring now to FIG. 13 there is shown a fifth preferred embodiment of the invention utilizing a flapper type wire line retrievable safety valve of the type shown in FIGS. 5*a*, 5*b*, 6*a*, and 6*b* acting as a substitute for a previously installed flapper type tubing retrievable safety valve described of the type shown in FIGS. 7*a*, 7*b*, 8*a*, and 8*b*.

FIG. 13 shows only the lowermost portion of the disabled flapper valve of the type shown in FIGS. 7*a*, 7*b*, 8*a* and 8*b* and these parts are designated by the same reference characters as in FIGS. 7*a* to 8*b*. However, the remainder of the components corresponding to those in FIGS. 5*a* to 6*b* are the same as used in describing those figures but are distinguished therefrom by the addition of one hundred and a prime. The substituted wire retrievable safety valve is shown emplaced and locked into position by a wire line manipulatable coupling assembly 134' with modified upper tubular housing section 150' holding flapper 31' of the tubing retrievable valve open. The remainder of the substitute wire line retrievable valve (shown closed) is identical in construction and operation to the valve described in FIGS. 5*a*, 5*b*, 6*a*, and 6*b*. The solenoid coils 111' and covering 135' were part of the original installation when the tubing string shown in FIG. 4 was installed. In other words surplus coils are present on the landing nipple initially in case it subsequently becomes desirable to install a substitute wire line retrievable safety valve. This is likewise true with respect to one half of coupling 134'. However, conductors 36 in cable 10 may be run separately or combined with the conductors 36 in cable 10 of the tubing retrievable valve solenoids.

From the foregoing it will be recognized that once the substitute safety cut-off valve is coupled to coupling 134', the newly installed valve not only replaces the function of the previously installed valve 31' but that tubular section 150' of the substitute valve holds the previously installed valve 31' open and shields it from contaminants and fluid flow.

Referring now to FIG. 14 there is shown another preferred embodiment employing a modified ball type wire line retrievable safety valve like that shown in FIGS. 9*a*, 9*b*, 10*a* and 10*b* and serving as a substitute for a ball type tubing retrievable safety valve of the type illustrated in FIGS. 11*a*, 11*b*, 12*a* and 12*b*. The previously installed ball valve components appearing at the top of FIG. 14 are designated by the same reference characters as in FIGS. 11*a* through 12*b* but the components of the substitute ball valve are distinguished from those characters by the addition of 200 to the previous numeral. The substitute ball-type wire line retrievable safety valve is shown emplaced and locked into position by coupling assembly 234'' with modified top tubular section 250'' holding ball 31''' open. The remainder of the substitute wire line retrievable valve, shown closed, is identical in construction and operation to the valve described in FIGS. 9*a* to 10*b*. It will be recalled that the solenoid coils 11 and covering 35 were emplaced at the time the tubing string was initially installed. However, conductors 36 in cable 10 may be run separately or combined with the conductors 36 in cable 10 of the tubing retrievable valve solenoids.

The preferred embodiments shown in FIGS. 13 and 14 are interchangeable in that the flapper type wire line retrievable safety valve may be used as a substitute for the ball type tubing retrievable safety valve and the ball type wire line retrievable safety valve may be used as a substitute for the flapper type tubing retrievable safety valve.

All of the above described safety cutoff valves employ a magnetic pole piece to aid opening of the valve and holding it open thereby allowing a very substantial reduction in the power used to maintain the valve open. Referring now to FIGS. 15 and 16 there is shown suitable mechanical clutch or restraining means as a substitute for the magnetic pole piece.

It will be understood that this mechanical restrain for the armature is designed to engage and clutch the tandem armature of any of the above-described embodiments as the armature reaches its retracted position wherein either a flapper or a ball valve is fully open. Thus its function is to aid in holding the valve open in the absence of a magnetic pole piece so long as the solenoid coils are energized but with a restraining force less than exhibited by the spring serving to extend the armature when the coils are de-energized and this is true whether a single or multiple clutches are utilized in tandem. Accordingly, FIGS. 15 and 16 merely illustrate a single mechanical armature restraining device embracing the tubular tandem armature near one end of a single one of solenoids.

Referring now to FIGS. 15 and 16 it is pointed out that a typical mechanical restrain comprises a non-magnetic tube 80 installed between adjacent sections 81,82 of the nonmagnetic tubular housing embraced by the nonmagnetic landing nipple 84. Suitably secured, as by welding, to the interior tube 80 is a collet of resilient fingers 85 having cam-shaped inwardly projecting protrusions 86 positioned to engage and bear against a cam-shaped detent 87 encircling the non-magnetic section 88 of the tandem tubular armature sub-assembly when this sub-assembly is in its retracted position to hold the cut-off valve, not shown, open. This valve-open condition is shown in FIG. 16 wherein it will be noted protrusions 86 are engaged with the upper end surface of detent 87. It will of course be understood that solenoid coil 89 is then energized and effective to pull the magnetic armature tube 90 downwardly toward the lower end of the coil in the same manner described in detail above in connection with FIGS. 4 to 14. It will therefore be evident that, so long as the solenoid coil or coils are energized, protrusions 86 and detent 87 serve as restraint means to hold the armature in its retract position in opposition to the armature extending spring, not shown but allowing the armature to shift to its extended position when the coils are de-energized. However, so long as the armature sub-assembly is in retracted position to hold either a ball or a flapper valve open, the power to the solenoid coils may be very substantially reduced and the sensitivity of the safety valve to abnormal flow conditions increased advantageously for self-obvious reasons.

Referring now to FIGS. 17–19, there is shown another embodiment of the invention utilizing cascaded tandem solenoids cooperating to deliver maximum actuating power to any of many types of readily controlled devices, for example, a safety cutoff valve for installation in a well bore. Such valves and other equipment requiring considerable power delivered over a long operating stroke impose taxing demands on solenoids. These demands are fulfilled efficiently and in a most advantageous manner utilizing the operating principles applied as shown by way of illustration in FIGS. 17–19.

In that embodiment, the tandem solenoids are arranged to drive a cascaded armature developing high power effectively and efficiently despite its unusually long stroke. Thus, the armature is divided into individual sections interconnected by lost motion connections and so arranged that the armature sections approach their respective retracted positions in out-of-phase relation and assume their share of the load primarily while relatively close to their fully retracted position.

Referring now to FIGS. 17, 18, and 19 wherein the cascaded tandem solenoids are utilized to operate a fail-safe safety cutoff valve of the same type disclosed above, the same or similar components being identified by the same reference characters but distinguished therefrom by the addition of 500. Only two solenoid coils 511, 511 have been shown but it will be understood that any suitable number may be employed in the same general tandem arrangement along with an associated armature section 526,528 coupled by a suitable lost motion connection to an adjacent armature section. It will be noted that the tandem solenoid coils 511 are supported in spaced-apart axial relation on the landing nipple 519 with the lower ends of each radially opposite combined couplings and pole pieces of magnetic material 518. A similar coupling 519 provides a seat for the lower end of the long coil spring 530. The upper end of this spring bears against a coupling sleeve 550 interconnecting the two halves of the non-magnetic tube 527. This spring serves as in the previously described embodiments to return the tandem armature to its extended position when coils 511 are de-energized.

The non-magnetic tubes 527 between each pair of adjacent magnetic sections of the armature have a lost motion connection with the adjacent overlying magnetic section and a positive or threaded connection with the adjacent underlying magnetic section. Thus the lower end of tube 527 is threaded to the upper end of armature 528 whereas its uppermost end has a lost motion sliding fit within the lower end of the associated magnetic section 526. This sliding fit occurs within the deeply stepped lower end of armature section 526 and of each armature section thereabove if more than two solenoid coils are being used. When the several solenoid coils are de-energized and the armature assembly is held fully extended by spring 530, the upper ends of the non-magnetic sections 527 are fully telescoped into armature sections 526 and seated against shoulders 580. The lower ends of each of the armature sections are then spaced at progressively greater distances from their respective pole pieces, the uppermost armature section being closest to its pole piece and the lowermost armature section being fartherest from its pole piece. By this technique it is feasible to develop high power over a long armature stroke.

This will be readily apparent from a consideration of FIGS. 17–19 showing the positions of the armature assembly as this assembly advances from its extended position in FIG. 17, to an intermediate position in FIG. 18, and then to its fully retracted position in FIG. 19 with each armature section seat against its own pole piece. Note that energization of the solenoid coils 511, the uppermost solenoid section 526 is spaced relatively close to its pole piece 518 whereas the next lower armature section 528 is relatively distant from its pole piece 518. While section 526 was moving to its retracted position, it was also effective in aiding the next lower solenoid coil to advance armature section 528 into a more effective position relative to its pole piece 518. In this manner it will be recognized that each coil and its associated armature section mutually assist one another in advancing the armature assembly into contact with the pole piece of each armature section in out of phase sequence while opening valve 531.

The long and yet powerful stroke made possible by cascading tandem solenoids equipped with armature sections provided with suitable lost motion connections can be utilized in many ways. In the illustrated application of the invention, the cascaded solenoids serve not only to provide a long power stroke to open a safety cutoff valve in larger sizes of tubing strings but the stroke is adequately long to move the protective tubular shield 529 into a position protecting both the valve seat and the entire periphery of valve 531 from contact with foreign matter so long as the armature assembly is held in its retracted position as shown in FIG. 19.

When coils 511 are de-energizing, or the flow through the armature assembly becomes excessive, spring 530 acts to extend the armature sections as the upper ends of sections 527 contact first one and then another of the shoulders 580 at the lower ends of the armature sections overlying the lowest armature section 528.

It will be recognized that no one of the various embodiments of this invention have need for perforations through any part of the tubing string or through the landing nipple to accommodate electrical conductors or any other feature of the invention.

While the particular tandem solenoid-controlled safety cut-off valve for a fluid well herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

We claim:

1. A fail-safe safety cut-off valve assembly suitable for use submerged and supported coaxially of the tubing string of a fluid well comprising: an open-ended tubular housing of non-magnetic material adapted to form a tubular portion of said tubing string; tandem solenoid coil means surrounding said tubular housing; tandem armature means comprising tubular tandem armature sections associated one with a respective one of said solenoid coil means and reciprocally supported within said housing for movement between extended and retracted positions axially of said solenoid coil means; cut-off valve means and valve seat means operatively associated with said tandem armature means; means biasing said valve means closed against said valve seat means and biasing said tandem armature means to said extended position when said solenoid coil means are de-energized; said solenoid coil means, when energized, being effective to shift said tandem armature means to said retracted position and to open said cut-off valve means; and means interconnecting and providing a fluid seal between said valve seat means and the interior of said tubular housing.

2. A valve assembly as defined in claim 1 characterized in the provision of armature restraining means within said housing engageable with a portion of said tandem armature means when in the retracted position thereof and cooperable with said solenoid coil means to hold said valve means open with less power supplied to said solenoid coil means than initially required to move said tandem armature means to the retracted position thereof.

3. A valve assembly as defined in claim 2 characterized in that said armature restraining means comprises a resilient collet cooperable with detent means to hold said tandem armature means retracted when said tandem solenoid coil means are energized.

4. A valve assembly as defined in claim 2 characterized in that said portion of said armature means engaged by said armature restraining means is formed essentially of said non-magnetic portion of said tandem armature means.

5. A valve assembly as defined in claim 4 characterized in that said armature restraining means is located intermediate the opposite ends of at least one of said solenoid coil means.

6. A valve assembly as defined in claim 1 characterized in the provision of a tubular magnetic pole piece positioned inwardly of one end of at least one of said tandem solenoid coil means and engageable with an end of the associated one of said tandem armature sections as the latter reaches the retracted position thereof to hold said valve means in open position.

7. A valve assembly as defined in claim 1 characterized in the provision of a tubular magnetic pole piece positioned inwardly of one end of at least a plurality of said tandem solenoid coil means and engageable with a respective one of said tandem armature sections when said tandem armature means is in said retracted position.

8. A valve assembly as defined in claim 1 characterized in that said valve seat means and said valve means are located near the lower end portion of said valve assembly and that said valve means is pivotable about a generally horizontal axis between the open and closed positions thereof.

9. A valve assembly as defined in claim 8 characterized in that said valve means comprises a flapper type valve.

10. A valve assembly as defined in claim 8 characterized in that said valve means includes a ball valve having a diametric flow opening and also includes means operatively connecting the same to said tandem armature means to rotate said ball valve between open and closed position as said tandem armature means moves between the extended and retracted positions thereof.

11. A valve assembly as defined in claim 10 characterized in that said valve means includes means supporting said valve means within said tubular housing independently of said tandem armature means.

12. A valve assembly as defined in claim 10 characterized in that said tandem armature means includes aligned tubular portions disposed on the opposite axial sides of said ball valve and in engagement with juxtaposed surfaces thereof when said tandem armature means is in either the extended or the retracted position thereof.

13. A valve assembly as defined in claim 8 characterized in that said valve means comprises a flapper valve supported adjacent one end and independently of said tandem armature sections.

14. A valve assembly as defined in claim 1 characterized in that said means interconnecting said valve seat means to said tubular housing includes wireline-operable disconnect means holding the portions of said valve assembly located inside said tubing string detachably assembled to said tubing string.

15. A valve assembly as defined in claim 1 characterized in that said valve assembly includes a non-magnetic landing nipple threaded at the opposite ends thereof for connection between the ends of adjacent sections of a tubing string; and said tandem solenoid coil means being mounted about the exterior of said landing nipple in axially spaced apart relation.

16. A valve assembly as defined in claim 1 characterized in that said tandem solenoid coil means include a separate solenoid coil radially opposite a respective one of said tandem armature sections of said tubular armature, at least one additional solenoid coil embracing said tubular housing axially below said first mentioned tandem solenoid coil means and in position to activate the armature of a substitute safety cut-off valve installable via wireline through said first mentioned safety cut-off valve, and said tubular housing having coupling means interiorly thereof below the lower end of said first mentioned safety cut-off valve adapted to be coupled to a complementary coupling of said substitute safety cut-off valve.

17. A valve assembly as defined in claim 16 characterized in the provision of a substitute safety cut-off valve coupled to said coupling means located below said first mentioned safety cut-off valve, said substitute valve having a normally closed cut-off valve provided with a magnetic tubular armature spring-biased to the extended position thereof and operable when said at least one solenoid coil is energized to move to the retracted position thereof and open said normally closed cut-off valve of said substitute safety cut-off valve.

18. A valve assembly as defined in claim 17 characterized in that said substitute valve includes means operable to hold the valve means of said first mentioned cut-off valve open so long as said substitute safety valve is installed therebelow.

19. A valve assembly as defined in claim 17 characterized in that said substitute valve is a flapper valve spring-biased to its closed position.

20. A valve assembly as defined in claim 17 characterized in that said valve comprises a normally closed rotatable ball valve mechanism operable between open and closed position by said tubular armature.

21. A valve assembly as defined in claim 16 characterized in the provision of a plurality of axially spaced-apart solenoid coils embracing said tubular housing below said first mentioned tubular housing and adapted to activate a respective magnetic section of a tandem armature of a substitute safety cut-off valve when the latter is coupled to said last mentioned coupling means.

22. A valve assembly as defined in claim 1 characterized in the provision of means remote from said valve assembly to adjust the power supply to said tandem solenoid coil means to vary the magnetic strength thereof.

23. A valve assembly as defined in claim 1 characterized in the provision of means remote from said valve assembly to supply greater power to said tandem solenoid coil means when shifting said tandem armature means to the retracted position to open said valve means and for thereafter reducing the power supply to a value adequate to hold said valve means open.

24. A fail-safe safety cut-off valve assembly for a fluid well comprising: a tubular housing adapted to be installed between the adjacent ends of contiguous sections of a tubing string, a cut-off valve sub-assembly mounted within said housing including valve seat means and valve means biased toward closed position thereagainst, tandem solenoid coil means for opening and retaining said valve means open, tubular tandem armature means comprising a separate magnetic section for each of said solenoid coil means separated by non-magnetic means and reciprocally mounted axially of said housing for movement between an extended position wherein said valve means is closed on said valve seat means and a retracted position wherein said valve means is held open, said tandem solenoid coil means being operable when energized to shift said tandem armature means to said retracted position and to retain said valve means in open position.

25. A valve assembly as defined in claim 24 characterized in that said cut-off valve sub-assembly includes wireline manipulatable coupling means for securing the same detachably to the interior of said tubular housing.

26. A cut-off valve assembly as defined in claim 24 characterized in that said tandem-solenoid coil means encircles said tubular housing along portions thereof to either axial side of said valve means and includes additional solenoid coil means arranged and available for use to activate the magnetic armature of a second safety cut-off valve when a second valve is installed via wireline radially opposite said last mentioned coil means.

27. A cut-off valve assembly as defined in claim 24 characterized in that said tandem-solenoid coil means are operable to hold said valve means open with reduced power supply thereto as compared with the greater power supply required to open said valve means.

28. A cut-off valve assembly as defined in claim 24 characterized in the provision of tubular magnetic pole-piece means spaced axially below a respective one of said magnetic armature sections and positioned to engage said armature sections when said tandem solenoid coil means are energized.

29. A cut-off valve assembly as defined in claim 24 characterized in the provision of mechanical clutch means operable to engage and restrain said tandem armature means in its retracted position so long as said tandem solenoid coil means are energized and to release said armature for movement to the extended position thereof when said coils are de-energized.

30. A cut-off valve assembly as defined in claim 24 characterized in the provision of wireline manipulatable means detachably coupling said cut-off valve sub-assembly to said tubular housing of said tubing string thereby permitting removal of said sub-assembly as a unit.

31. A cut-off valve assembly as defined in claim 24 characterized in that said valve means comprises a flapper valve pivotally supported near one edge of said valve seat means.

32. A cut-off valve assembly as defined in claim 31 characterized in that said flapper valve is positioned exteriorly of said tandem armature means so long as said tandem armature means is in the retracted position thereof.

33. A cut-off valve assembly as defined in claim 24 characterized in that said tandem armature means is reciprocal axially through said valve seat means while moving between the extended and retracted positions thereof and is effective to isolate said valve seat means from contact with flowing well fluid while holding said valve means open.

34. A valve assembly as defined in claim 1 characterized in that said tandem armature sections are movable axially of one another and, when extended, are spaced progressively further from their respective retracted positions whereby, upon energization of said solenoid coil means, said armature sections move in sequence to their respective retracted positions while mutually assisting one another to increase the stress in said means biasing said valve means closed and said armature means to the retracted position thereof.

35. A valve assembly as defined in claim 34 characterized in that biasing means comprises coil spring means operable to shift the tandem armature section closest to said valve means partially back toward the extended position thereof before shifting the next more distant armature section toward its extended position.

36. A valve assembly as defined in claim 24 characterized in that said separate magnetic armature sections are arranged to move axially of one another through a limited range to respective retracted positions in out-of-phase sequential order while cooperating to open said valve means.

37. A valve assembly as defined in claim 36 characterized in that said magnetic armature sections and the associated one of said solenoid coil means are arranged in axial alignment, a magnetic pole piece means for each of said solenoid coil means, means providing an axial lost motion connection between adjacent armature sections and cooperating with spring means to hold said armature sections progressively further from their respective pole pieces when said solenoid coil means are de-energized, and said solenoid coil means, when energized, being effective to compress said spring means and to open said valve means as said armature sections are shifted into contact with their respective pole pieces in succession in out-of-phase order.

38. A valve assembly as defined in claim 24 characterized in that said tandem solenoid coil means and the associated tandem armature sections are so constructed and arranged as to move said valve means to open position as first one and then another of said armature sections reaches a respective retracted position in out-of-phase sequential order.

39. A valve assembly as defined in claim 38 characterized in the provision of coil spring means operable when said solenoid coil means is de-energized to shift said tandem armature sections to their respective extended positions in the reverse order to the movement thereof when cooperating to open said valve means.

40. A valve assembly as defined in claim 38 characterized in the provision of means providing limited-range telescopic movement between adjacent ones of said armature sections.

41. A solenoid controlled device comprising: a plurality of coils separate magnetic armature means for each of said coils and each biased to a different distance from its associated pole piece when said coils are de-energized, means operatively connected to and actuatable by said armature means as said armature means move in succession in out-of-phase relation into contact with their respective pole pieces when said coils are energized, and non-magnetic armature restraining means within said housing positioned to engage a portion of said armature means when in the retracted position thereof to hold said actuatable means open thereby permitting said solenoid coils to be energized with less power than initially required to move said armature means to the retracted position thereof.

42. A solenoid-controlled device as defined in claim 41 characterized in that said coils are arranged in axial alignment.

43. A solenoid-controlled device as defined in claim 41 characterized in that said actuatable means comprises a flow control valve.

44. A solenoid-controlled device as defined in claim 41 characterized in the provision of limited-range lost motion means interconnecting adjacent ones of said armature means.

45. A solenoid-controlled device as defined in claim 41 characterized in the provision of spring means operable to bias each of said armature means to the extended position thereof when said coils are de-energized.

46. A solenoid-controlled device as defined in claim 40 characterized in that said separate armature means are tubular.

47. A solenoid-controlled device as defined in claim 46 characterized in that said actuatable means comprises valve means including a flow passage therethrough rotatable between open and closed positions depending on whether said coils are energized or de-energized.

48. A solenoid-controlled device as defined in claim 46 characterized in that said actuatable means comprises pivoting valve means movably supported and operable between the open and closed positions thereof by the energization and de-energization respectively of said plurality of coils.

49. A solenoid-controlled device as defined in claim 40 characterized in the provision of tubular means of non-magnetic material positioned between said coils and each of said armature means.

50. A solenoid-controlled device as defined in claim 40 characterized in the provision of non-magnetic means interconnecting adjacent ones of said separate armature means.

51. A solenoid-controlled valve assembly comprising: a tubular housing, a plurality of axially aligned tandem solenoid coils coaxially of said housing, open-ended tubular tandem armature means embraced by said solenoid coils and reciprocally supported for movement between an extended position and a retracted position, means biasing said armature means to said extended position, means providing a valve seat coaxially of said armature means and having a diameter at least as great as the internal diameter of said armature means, a valve movably supported for movement between a closed position on said valve seat and an open position displaced from said seat, and said tandem solenoid coils being operable when energized to move said tandem armature means to the retracted position thereof and to move said valve to said open position to provide a substantially unobstructed flow path through said tubular armature means and said valve seat.

52. A solenoid-controlled valve assembly as defined in claim 51 characterized in the provision of a separate pole piece of magnetic material embracing said armature means adjacent one end of an associated one of said solenoid coils and positioned to abut a respective shoulder portion on the exterior of said armature means when said solenoid coils are energized.

53. A solenoid-controlled valve assembly as defined in claim 51 characterized in that said armature means includes a tubular portion positioned for movement axially through said valve seat as said armature means moves to the retracted position thereof in response to the energization of said solenoid coils.

54. A solenoid-controlled valve assembly as defined in claim 51 characterized in that said armature means comprises sections of magnetic material interconnected by sections of non-magnetic material.

55. A solenoid-controlled valve assembly as defined in claim 51 characterized in that said valve comprises a pivotally supported flapper member normally spring biased to the closed position thereof adjacent one end of said armature means when said armature means is in the extended position thereof, and said one end of said armature means being operable to open said flapper member and to hold the same out of the flow path through said armature means when said solenoid coils are energized.

56. A solenoid-controlled valve assembly as defined in claim 55 characterized in the provision of a tubular chamber surrounding said flapper member and cooperating with said armature means to substantially isolate said flapper member from the path of fluid flow to be controlled by said valve.

57. A solenoid controlled valve assembly as defined in claim 55 characterized in the provision of a tubular chamber surrounding said flapper member and said valve seat and sized to cooperate with the adjacent end portion of said armature means when in the retracted position thereof to substantially isolate said flapper member and said valve seat from the flow path of fluid through said armature means when said solenoid coils are energized.

58. A solenoid-controlled valve assembly as defined in claim 51 characterized in that said solenoid coils embrace the exterior of said tubular housing.

59. A solenoid-controlled valve assembly comprising: a tubular housing, a solenoid coil carried coaxially of said housing armature means reciprocally supported coaxially of said coil and spring biased to an extended position but movable to a retracted position when said coil is energized, means providing a valve seat, a valve movably supported and operably associated with said armature means for movement between the open and closed positions thereof by movement of said armature means between the extended and retracted positions of said armature means, and non-magnetic armature restraining means positioned to engage said armature means when in the retracted position thereof thereby enabling said solenoid coil to hold said armature means in said retracted position with less power consumption than initially required to move said armature means to the retracted position thereof.

60. A valve assembly as defined in claim 59 characterized in that said armature means is axially aligned with said valve seat.

61. A valve assembly as defined in claim 60 characterized in that said armature means is tubular, and said valve seat having a diameter at least as great as the internal diameter of said armature means.

62. A valve assembly as defined in claim 60 characterized in that said armature means is positioned to move from an extended position generally to one axial side of said valve seat to a retracted position on the other axial side of said valve seat thereby to shield said valve seat from fluid flow therepast while said solenoid coil is energized.

63. A valve assembly as defined in claim 62 characterized in that said valve means is pivotally supported for movement to an open position along the exterior of said tubular armature means when the latter is in the retracted position thereof.

* * * * *

UNITED STATES PATENT AND TRADEMARK OFFICE

CERTIFICATE OF CORRECTION

PATENT NO. : 4,191,248

DATED : March 4, 1980

INVENTOR(S) : DONALD L. HUEBSCH and LOUIS B. PAULOS

It is certified that error appears in the above-identified patent and that said Letters Patent are hereby corrected as shown below:

Column 15, Claim 20, line 8, before "valve" insert -- substitute --.

Column 17, Claim 46, line 48, change "40" to -- 41 --

Column 17, Claim 49, line 62, change "40" to -- 41 --

Column 17, Claim 50, line 66, change "40" to -- 41 --

Signed and Sealed this

*Fourteenth* Day of *April 1981*

[SEAL]

*Attest:*

RENE D. TEGTMEYER

*Attesting Officer*

*Acting Commissioner of Patents and Trademarks*